US007625845B2

(12) United States Patent
Wang et al.

(10) Patent No.: US 7,625,845 B2
(45) Date of Patent: Dec. 1, 2009

(54) METHOD OF USING THERMAL INSULATION FLUID CONTAINING HOLLOW MICROSPHERES

(75) Inventors: Xiaolan Wang, Spring, TX (US); Qi Qu, Spring, TX (US)

(73) Assignee: BJ Services Company, Houston, TX (US)

( * ) Notice: Subject to any disclaimer, the term of this patent is extended or adjusted under 35 U.S.C. 154(b) by 432 days.

(21) Appl. No.: 11/595,295

(22) Filed: Nov. 9, 2006

(65) Prior Publication Data

US 2008/0113883 A1 May 15, 2008

(51) Int. Cl.
*C09K 8/60* (2006.01)
*C09K 8/68* (2006.01)
*E21B 36/00* (2006.01)

(52) U.S. Cl. ..... 507/219; 507/211; 507/926; 166/302

(58) Field of Classification Search ..... 166/57, 166/302; 507/211, 219
See application file for complete search history.

(56) References Cited

U.S. PATENT DOCUMENTS 2,797,201 A 6/1957 Veatch et al.
3,030,215 A 4/1962 Veatch et al.
3,230,184 A 1/1966 Alford
3,365,315 A 1/1968 Beck et al.
3,700,050 A * 10/1972 Miles ..... 175/65
3,827,978 A * 8/1974 Miles ..... 507/203
3,851,704 A 12/1974 Maxson et al.
6,225,361 B1 * 5/2001 Nakajima ..... 521/57
6,489,270 B1 12/2002 Vollmer et al.
6,810,959 B1 11/2004 Qu et al.
6,832,652 B1 12/2004 Dillenbeck et al.
7,306,039 B2 12/2007 Wang et al.
2004/0011990 A1 * 1/2004 Dunaway et al. ..... 252/62
2004/0059054 A1 3/2004 Lopez et al.
2005/0113264 A1 5/2005 Vollmer
2006/0131536 A1 6/2006 Qu et al.
2006/0211580 A1 9/2006 Wang et al.
2007/0259791 A1 11/2007 Wang et al.

OTHER PUBLICATIONS

Javora, P.H., et al.; "Water-Based Insulating Fluids for Deep-Water Riser Applications;" Oct. 2004; SPE 88547; Society of Petroleum Engineers, Inc., USA.
Wang, X., et al.; "Thermal Insulating Fluid and Its Application in Deepwater Riser Insulations in the Gulf of Mexico;" Oct. 2003; SPE 84422; Society of Petroleum Engineers, Inc., USA.
"3M Scotchlite™ Glass Bubbles K Series, S Series;" 3M Performance Materials Division; 2003; pp. 1-8; St. Paul, MN.
"Tiny Spheres. Big Science.;".

* cited by examiner

*Primary Examiner*—Timothy J. Kugel
*Assistant Examiner*—Aiqun Li
(74) *Attorney, Agent, or Firm*—Jones & Smith, LLP; John Wilson Jones

(57) ABSTRACT

A thermal insulating fluid contains microspheres of hollow spherical particulates. The presence of the hollow spherical particles improves the thermal insulating properties of the fluid by imparting to the thermal insulating fluid a low heat transfer coefficient. The hollow particulates may be inorganic or organic in nature and include hollow spheres of glass, ceramics and plastics. The thermal insulating fluid is capable of controlling the heat transfer from a production tubing or transfer pipe to one or more surrounding annuli and the environment. In addition to reducing heat transfer in the producing well, heat transfer in the fluid produced from the well is also minimized.

21 Claims, 1 Drawing Sheet

METHOD OF USING THERMAL INSULATION FLUID CONTAINING HOLLOW MICROSPHERES

FIELD OF THE INVENTION

Heat transfer in oilfield applications may be reduced by the use of a thermal insulating fluid which contains low density hollow spherical particles.

BACKGROUND OF THE INVENTION

Undesired heat loss from production tubing as well as uncontrolled heat transfer to outer annuli can be detrimental to the mechanical integrity of outer annuli, cause productivity losses from the well, increase deposition of paraffin and asphaltene materials, accelerate the formation of gas hydrates and destabilize the permafrost in arctic type regions.

Environmentally friendly wellbore insulating fluids developed in the last several years have been very efficient in minimizing heat loss and reducing heat transfer in the well. When introduced into an annulus or riser, such fluids effectively reduce undesired heat loss from the production tubing and/or heat transfer to the outer annuli. Such fluids typically function as packer fluids by insulating the producing fluid. In some cases, heat loss from the produced fluids due to conduction and convection can be reduced by more than 90% when compared with conventional packer fluids.

Non-crosslinked insulating fluids are useful in securing the insulation of wellbore to reduce the heat transfer from the production tubing to the surrounding wellbore, internal annuli, and the riser environment are disclosed in U.S. Pat. No. 6,489,270. The fluid viscosity of such insulating fluids makes it easier to pump the fluid into the annulus; the fluid density of such fluids being controlled by the amount and type of dissolved salt. Such salt is needed to provide positive control of the wellbore pressure without the risk of solid settling and separation. Heat transfer in the well is minimized as evident by the heat retention of the produced fluid.

Fluids having improved insulation properties have further been reported in U.S. Patent Publication No. 2004/0059054 A1. Such fluids containing superabsorbent polymers provide a viscous fluid with low heat transfer coefficient and low convection velocity. The cool-down time, i.e., the time required for the produced hydrocarbon to cool down to the temperature for paraffin, asphaltene and hydrate formation after production is interrupted, however is often shorter than desired.

Alternative fluids having improved insulation properties and methods of using such fluids continue to be sought wherein the fluids are environmentally friendly, exhibit low heat transfer coefficient and further exhibit a longer cool-down time than seen in the fluids of the prior art. In addition, such alternative fluids need to be capable of securing the insulation of the wellbore while reducing the amount of heat transfer from the production tubing to the surrounding wellbore, internal annuli and riser.

SUMMARY OF THE INVENTION

A thermal insulating fluid capable of controlling heat transfer from a production tubing or transfer pipe to one or more surrounding annuli and the environment contains hollow microspheres which imparts to the fluid a low heat transfer coefficient. The fluid, when pumped into an annuli surrounding the production tubing or transfer piping, enhances the thermal insulating quality around the tubing or piping, thereby reducing heat loss from it. Heat transfer is reduced in the producing well as heat transfer in the fluid produced from the well is minimized.

The thermal insulating fluid contains microspheres of hollow spherical particulates which typically contain entrapped liquid or gas. The resulting fluid exhibits much lower heat transfer coefficient as compared to a fluid which does not contain the hollow spherical particulates.

The hollow particulates may be inorganic or organic in nature. Suitable particulates include hollow spheres of glass (including borosilicate glass), ceramics and plastics. Hollow spheres of synthetic resins include acrylonitrile homopolymers and copolymers, such as acrylonitrile/vinyl chloride copolymers; styrenic polymers; polyvinylidene polymers and copolymers, such as polyvinylidene chloride homopolymers and copolymers; as well as polyethylene.

The thermal insulating fluid may further contain a viscosifying polymer such as a polysaccharide, or a block or random copolymer containing units selected from vinyl alcohol, acrylates, including the (meth)acrylates, pyrrolidone, 2-acrylamido-2-methylpropane sulfonate and acrylamide including the (meth)acrylamides.

In addition, the fluid may further include a solvent, such as a polyol.

The thermal insulating fluid is capable of reducing convection flow velocity within the annulus. In a preferred embodiment, the fluid is a packer or riser fluid and the packer fluid is introduced above the packer in an annulus whereas the riser fluid is introduced into a riser annulus.

BRIEF DESCRIPTION OF THE DRAWINGS

In order to more fully understand the drawings referred to in the detailed description of the present invention, a brief description of each drawing is presented, in which.

DETAILED DESCRIPTION OF THE PREFERRED EMBODIMENTS

Figure 1:
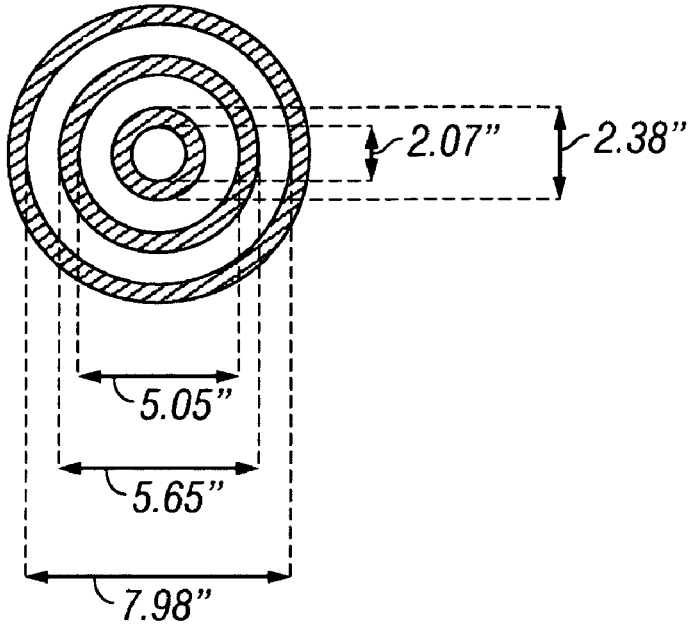
FIG. 1 illustrates the concentric tube dimensions for a heat transfer apparatus used to determine the thermal insulation effectiveness of exemplified fluids.

The thermal insulating fluid for use in the method defined herein contains microspheres of hollow spherical particulates. The presence of the hollow spherical particulates imparts to the thermal insulating fluid a low heat transfer coefficient. In essence, the heat transfer coefficient of a thermal insulating fluid containing the hollow spherical particulates is less than the heat transfer coefficient of a substantially similar thermal insulating fluid which does not contain hollow microspheres. The spheres are typically rapidly and easily dispersed with moderate shear mixing in a liquid medium.

Liquid or gas may be entrapped within the spherical particulates. Suitable gases for encapsulation in the spheres include nitrogen as well as compressed air. Typical liquids include light hydrocarbons. Entrapment typically results in confinement of gas or liquid within the spheres, e.g., in the form of small bubbles, and results by expanding a solid material. Typically, the amount of liquid or gas in the sphere is below 5% w/w of the expanded sphere, preferably below 3% w/w, more preferably below 1% w/w. Upon expansion, only a residual amount if any of the hydrocarbon gas/liquid core thus remains; accordingly, thus the microspheres are generally referred to as being "hollow". By incorporating liquid or gas into the insulating fluid system, the insulation properties of the fluid are improved since the entrapped gas or liquid exhibits a much lower thermal conductivity.

The microspheres are small particles with low true density. Preferably, the microspheres exhibit a density of between from about 0.25 to about 0.6, most preferably about 0.35 to 0.40, g/cc. Further, the mean diameter of such microspheres may be less than 1000 microns, preferably less than 200 microns, most preferably less than about 150 microns.

The microspheres may be inorganic or organic in nature. The inorganic microspheres are preferably glass microspheres or microbubbles such as those described in U.S. Pat. No. 3,365,315 and include borosilicate glass. Alternatively, the inorganic microspheres may be composed of ceramic. The walls of these microspheres are made by expanding solid glass particles at temperatures above 1000° C. to form hollow spheroids having an apparent density in the range of about 0.14 to about 0.38 g/cc, a wall thickness of about 0.5 to 2.0 microns, and an average particle size of about 60 microns. Other suitable glassy or inorganic microspheres of synthetic fused water-insoluble alkali metal silicate-based glass are described in U.S. Pat. No. 3,230,184, and microspheres made of sodium silicate which are useful in the thermal insulating fluid are described in U.S. Pat. No. 3,030,215.

Hollow glass microspheres or glass bubbles which may be used include those available commercially from The 3M Company under the trade designation Scotchlite™ glass bubbles. The chemical properties of these glass bubbles may resemble those of a soda-lime-borosilicate glass. Other commercially available alternatives include hollow microspheres of borosilicate glass, such as Q-CEL®; and ceramic spheres, such as Extendospheres®, available from The PQ Corporation.

Organic resinous microspheres useful in the thermal insulating fluids are relatively inert and include microspheres of thermosetting resins such as epoxy resins; urea-formaldehyde resins; phenolic resins; as well as thermoplastic materials. Especially suitable are acrylonitrile homopolymers and copolymers such as acrylonitrile/vinyl chloride copolymers, styrenic polymers, polyvinylidene polymers and copolymers such as polyvinylidene chloride homopolymers and copolymers and polyethylene. Further suitable organic resinous microspheres include those set forth in U.S. Pat. No. 2,797,201. Commercially available microspheres composed of organic resins include such plastic hollow spheres like the PM-series available from The PQ Corporation, Expancel® hollow plastic spheres from Expancel, Inc., and polystyrene spheres, such as Styrocell® from SHELL.

These organic spheres further are typically prepared by expanding a solid material. For instance, the microspheres may be derived from flexible particulates of an organic resin referenced in the paragraphs above and a core that includes a liquid and/or gas which expands upon heating. Preferably, the core material is an organic substance that has a lower boiling point than the softening temperature of the polymeric shell. Examples of suitable core materials include propane, butane, pentane, isobutane, neopentane, and combinations thereof.

The microspheres for use in the thermal insulating fluid may further be coated with a material, such as colloidal calcium carbonate. Such microspheres are disclosed in U.S. Pat. No. 6,225,361.

The amount of microspheres incorporated in the thermal insulating fluid is based upon the desired properties of the fluid. In general, higher microsphere concentrations render reduce modulus and strength. In general, the amount of microspheres in the fluid ranges from about 0.1 to about 5 weight percent.

The thermal insulating fluid further preferably contains a viscosifying polymer such as a polysaccharide, preferably an anionic or nonionic polysaccharide. Suitable polysaccharides include guar gums and derivatives, cellulose, starch, and galactomannan gums.

Cellulose and cellulose derivatives include alkylcellulose, hydroxyalkyl cellulose or alkylhydroxyalkyl cellulose, carboxyalkyl cellulose derivatives such as methyl cellulose, hydroxyethyl cellulose, hydroxypropyl cellulose, hydroxybutyl cellulose, hydroxyethylmethyl cellulose, hydroxypropylmethyl cellulose, hydroxybutylmethyl cellulose, methylhydroxyethyl cellulose, methylhydroxypropyl cellulose, ethylhydroxyethyl cellulose, carboxyethylecellulose, carboxymethylcellulose and carboxymethylhydroxyethyl cellulose.

Suitable polysaccharides also include microbial polysaccharides such as xanthan, succinoglycan and scleroglucan as well as galactomannan gums and derivatized galactomannan gums.

Specific examples of polysaccharides useful in the thermal insulating fluid include but are not limited to guar gum, hydroxypropyl guar, carboxymethylhydroxypropyl guar and known derivatives of these gums.

In addition, the viscosifying polymer of the thermal insulating fluid may be a block or random copolymer containing units selected from vinyl alcohol, acrylates, including the (meth)acrylates, pyrrolidone, 2-acrylamido-2-methylpropane sulfonate and acrylamide including the (meth)acrylamides.

The viscosifying polymer is typically present in the thermal insulating fluid at a range between from about 0.1 to about 5, preferably from about 1 to about 3, weight percent. The viscosifying polymer is included in order to provide a viscosity to the fluid sufficient to reduce the convection flow velocity within the annulus. The viscosity of the fluid is sufficient to reduce the convection flow velocity within the annulus and immobilize the water and/or brine.

Preferably, the thermal insulating fluid contains from about 20 to about 99 weight percent water or brine. The brine may be saturated or unsaturated brine. By saturated brine, it is understood that the brine is saturated with at least one salt.

The thermal insulating fluid may further include a solvent, such as a polyol. Such solvents are of assistance in keeping the viscosifying polymer dispersed in the fluid and to prevent it from decomposing while being subjected to the extreme conditions offered by deep wellbores. In addition, the solvent serves to reduce the thermal conductivity of the fluid and thus imparts thermal insulation to the fluid. In a preferred embodiment, the viscosifying polymer is introduced to the solvent and the resulting slurry is then added to the brine and the crosslinking agent, if present.

The viscosifier in the fluid may include clay and clay-like materials which further impart viscosity to the fluid. Such materials may be used in addition to the viscosifying agents referenced above. The solvent, in such circumstances, is compatible with such materials.

The solvent is preferably a polyol such as glycerol, a glycol or a polyglycols and mixtures thereof. The glycols include commonly known glycols such as ethylene glycol, propylene glycol and butylene glycol. The polyglycols can be selected from a wide range of known polymeric polyols that include polyethylene glycol, poly(1,3-propanediol), poly(1,2-propanediol), poly(1,2-butanediol), poly(1,3-butanediol), poly (1,4-butanediol), poly(2,3-butanediol), co-polymers, block polymers and mixtures of these polymers. A wide variety of polyglycols is commercially available. Most commercially available polyglycols include polyethylene glycol, and are usually designated by a number that roughly corresponds to the average molecular weight. Examples of useful commercially available polyethylene glycols include polyethylene glycol 4000 and polyethylene glycol 6000. Preferably the polymeric polyols are selected to have a number average molecular weight, $M_n$, of about 150 to about 18,000 Daltons. More preferably, the polymeric polyols are selected to have number average molecular weight of about 190 to about 10,000 D. Yet most preferably, the polymeric polyols are selected to have number average molecular weight of about 500 to about 8,000 D. When present, the thermal insulating fluid used in the methods recited herein typically contain between from about 10 to about 80 wt % of polyol.

Use of polyglycols having the described number average molecular weight provide a fluid that exhibits stable rheological properties especially at elevated temperatures and over extended periods of time. These polyglycols are particularly well suited for deep wellbores that exert high temperature and pressures on fluids.

The thermal insulating fluid may be prepared on the surface and then pumped through tubing in the wellbore or in the annulus. In a preferred embodiment, the fluid is a packer or riser fluid and the packer fluid is introduced above the packer in an annulus and the riser fluid is introduced into a riser annulus.

The fluid, when pumped into an annuli surrounding the production tubing or transfer piping, enhances the thermal insulating quality around the tubing or piping, thereby reducing heat loss from it. Heat transfer is reduced in the producing well as heat transfer in the fluid produced from the well is minimized.

The fluid further provides high viscosity at low shear rate so as to reduce the rate of fluid convection to near zero. Since convection is fluid motion caused by the variation of fluid density with temperature, increasing fluid viscosity decreases fluid motion, and correspondingly, decreases free annular convection. Thus, the desired rheological profile for the insulating fluid includes high viscosity at low shear rate in order to reduce the free fluid convection caused by temperature differential. Additionally, a low viscosity at high shear rate is desired to facilitate the placement of the insulating fluid at the desired location.

The thermal insulating fluids should be approached on a specific project basis to meet a target objective in terms of viscosity and density. Density is normally dictated by the required hydrostatic pressure needed to control the well, and may be achieved by the amount and type of salt dissolved within the fluid (resulting from the brine, etc). The densities of the thermal insulating fluids are controlled by operational considerations such as additives to the fluids, hydration time of viscosifier, and requirements for low crystallization temperatures (both true crystallization temperature (TCT) and pressure crystallization temperature (PCT). Densities to 13.0 pounds per gallon have been evidenced for the thermal insulating fluids. It is important that the fluids are formulated to have an appropriate low crystallization temperature for the adverse conditions of deep water. The insulating fluids have low pressure crystallization temperatures significantly less than 30° F. at 10,000 psi.

The thermal insulating fluid may be produced in shore-based facilities, transported to, and pumped from marine well-servicing boats into riser annuli. This provides a convenient means to blend, temporarily store, and then pump large quantities of fluid into the wellbore and riser annuli, without using rig tanks. The thermal insulating fluid is easy to blend and pump at the rigsite.

The thermal insulating fluid further offers environmental benefits since no oil sheen will be produced if the fluid is spilled since the fluid is oil-free. Further, while the fluid fluids vary according to specific well conditions, the components of the fluid are environmentally friendly.

The thermal insulating fluid may serve a dual purpose. First, they serve to prevent heat transfer/buildup in the outer annuli. Second, they serve to retain heat within the produced hydrocarbons. The fluids further provide lower viscosity at high shear rate to facilitate the fluid placement.

The following examples will illustrate the practice of the present invention in a preferred embodiment. Other embodiments within the scope of the claims herein will be apparent to one skilled in the art from consideration of the specification and practice of the invention as disclosed herein. It is intended that the specification, together with the example, be considered exemplary only, with the scope and spirit of the invention being indicated by the claims which follow.

EXAMPLES

The Examples examine the heat-retention ability of the insulating fluid defined herein versus an insulating fluid of the prior art by the cool-down curves to mimic the shut-in conditions of a producing well.

The thermal insulating fluid defined by the invention was prepared by adding 1.0 percent by weight of CMHPG to 25 volume percent of propylene glycol and 75 volume percent of sodium formate brine having a density of 9.0 lbs/gallons. To the brine was also added 0.5 weight percent of Expancel™ hollow plastic spheres, a product of Expancel, Inc., while stirring. Then a pH buffer was added to the prepared solution to adjust the system pH to above 9.0.

The thermal insulating properties of the thermal insulating fluid (Fluid II) was evaluated in a laboratory-sized heat transfer apparatus to determine the thermal effectiveness of the fluid and to simulate the fluid's dynamic behavior under thermal stress in a simulated wellbore. The fluid was contrasted with pure solvent and a non-crosslinked insulating fluid, (Fluid I), as taught in U.S. Pat. No. 6,489,270, containing 4 pounds per barrel of CMHPG to 9.0 ppg brine.

The heat transfer apparatus consisted of three concentric aluminum pipes connected and sealed by two flanges. The physical dimensions are shown in FIG. 1. Hot fluid at constant temperature was circulated in the inner pipe, while cold fluid at constant temperature was circulated in the outer annulus. The test insulating-fluid was contained in the annulus between the hot and cold reference fluids. The top and bottom of the apparatus were insulated to assure that heat flow was in the radial direction.

About 7000 ml of the test fluid was placed into the annulus of a laboratory-sized heat transfer apparatus for the test on each fluid. Hot fluid was allowed to enter the inner pipe at the bottom and leave the pipe at the top at approximately 0.3-1 gallon/minute and thus provided a hot surface at the inner annulus wall. The cold water was fed to the outside pipe of the heat transfer apparatus with a flow rate of 3 gallon/minute to provide a cold wall annulus adjacent to the packer annulus. The test insulating-fluid remained static in the packer annulus. Thermocouples were positioned on the inner wall (hot surface) and outer wall (cold surface) of the annulus, and at the inlet and outlet ports for the hot and cold flowing water.

During the test, hot water and cold water temperatures were set at 180° F. and 50° F., respectively. Cool down data was collected until the hot water temperature dropped below 60° F. After thermal equilibrium was achieved (2 to 3 hours) for a given test, data was collected to calculate heat transfer coefficient and apparent thermal conductivity and summarized in Table I wherein higher heat transfer coefficient and higher effective thermal conductivity translate into greater heat losses from a hot annulus through the insulating fluid into a cold annulus:

TABLE I

| | U (heat transfer coefficient) BTU/hr · ft$^2$ · ° F. |
|---|---|
| Solvent | 30.8 |
| Fluid I | 3.03 |
| Fluid II | 2.91 |

Table I illustrates that the inventive fluid systems exhibit excellent thermal insulating properties and can control heat loss as effectively as the fluid of the prior art.

Figure 2:
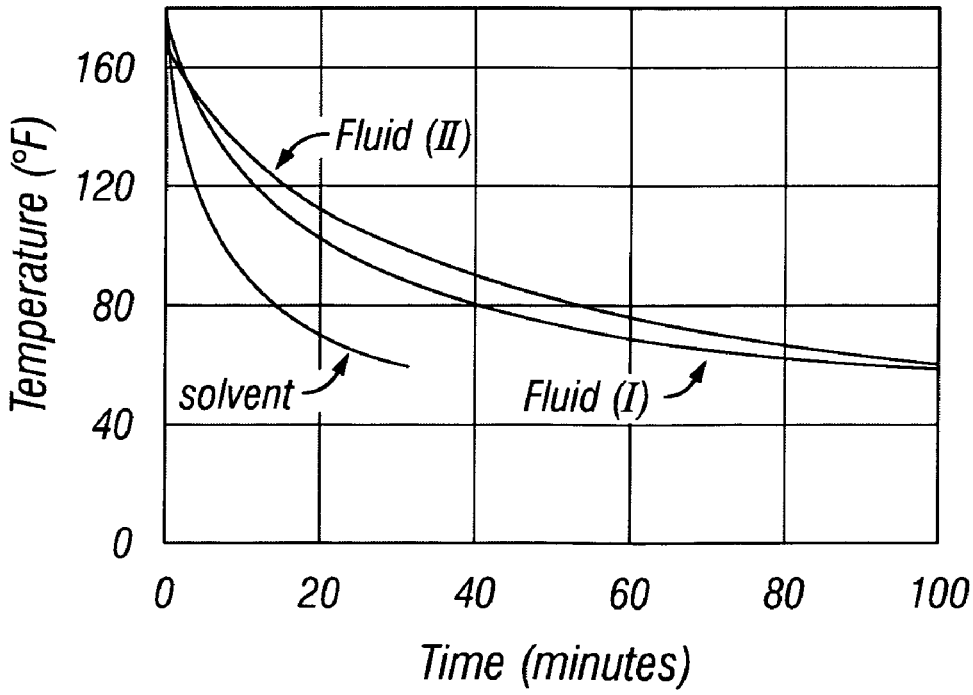
FIG. 2 illustrates the heat retention ability exhibited by the described thermal insulating fluid (Fluid II) versus an insulating fluid of the prior art (Fluid I), as discussed below in Example 1, and mimics the shut-in conditions of a producing well.

FIG. 2 illustrates the cool down results in comparison with the brine (solvent) and non-crosslinked insulating fluid. Taking cool-down to 80° F. as example, it took 18 minutes when the insulating material was brine (solvent), 40 minutes for the fluid of the prior art (Fluid I), and 55 minutes for the thermal insulating fluid defined herein (Fluid II). The slower cool-down rate from high to low temperature is indicative of the greater effectiveness of the insulating fluid. FIG. 2, therefore, demonstrates that in well shut-in situations, Fluid II retains heat more effectively than Fluid I of the prior art.

From the foregoing, it will be observed that numerous variations and modifications may be effected without departing from the true spirit and scope of the novel concepts of the invention.

What is claimed is:

1. A method for minimizing heat transfer in a fluid produced from a well which comprises:

(a) introducing into the well a thermal insulating fluid comprising:
  (i) a viscosifying polymer; and
  (ii) plastic hollow microspheres; and
(b) producing fluids from the well while minimizing heat transfer therein wherein the plastic hollow microspheres are expanded particulates of an organic resin and a heat expandable liquid or gas and further wherein the amount of plastic hollow microspheres in the thermal insulating fluid is between from about 0.1 to about 5 weight percent.

2. The method of claim 1, wherein the heat transfer coefficient of the thermal insulating fluid is less than about 3.0 BTU/hr ft$^{2\circ}$ F.

3. The method of claim 1, wherein the plastic hollow microspheres have a density between from about 0.25 to about 0.6 g/cc.

4. The method of claim 3, wherein the plastic hollow microspheres have a density between from about 0.35 to 0.40 g/cc.

5. The method of claim 1, wherein the organic resin is a homopolymer, copolymer or terpolymer of a member selected from the group consisting of ethylene, acrylonitrile, acrylate, (meth)acrylonitrile, (meth)acrylate, styrene, vinyl halide, vinylidene halide, vinyl acetate, butadiene, vinylpyridine and chloroprene.

6. The method of claim 1, wherein the organic resin is crosslinked.

7. The method of claim 1, wherein the viscosifying polymer is at least one member from the group consisting of polysaceharide or a block or random copolymer containing units selected from the group consisting of vinyl alcohol, acrylates, pyrrolidone, 2-acrylamido-2-methylpropane sulfonate and acrylamides.

8. The method of claim 7, wherein the viscosifying polymer is at least one polysaccharide selected from the group consisting of guar gums, cellulose, starch, galactomannan gums and derivatives thereof.

9. The method of claim 7, wherein the viscosifying polymer is at least one polysaccharide selected from the group consisting of alkylcelluloses, hydroxyalkyl celluloses, alkylhydroxyalkyl celluloses, carboxyalkyl celluloses and derivatives thereof.

10. The method of claim 1, wherein the fluid further comprises a polyol.

11. A method for reducing heat transfer in a producing well comprising the steps of:

(a) introducing into the well a thermal insulating fluid comprising:
  (i) a viscosifying polymer; and
  (ii) plastic hollow microspheres; and
(b) producing a fluid from the well while minimizing heat transfer therein wherein the plastic hollow microspheres are expanded particulates of an organic resin and a heat expandable liquid or gas and further wherein the amount of plastic hollow microspheres in the thermal insulating fluid is between from about 0.1 to about 5 weight percent.

12. A method for enhancing the thermal insulation of a production tubing or transfer pipe surrounded by at least one annuli comprising:

(a) introducing to the at least one annuli a thermal insulating fluid comprising:
  (i) a viscosifying polymer; and
  (ii) plastic hollow microspheres; and
(b) maintaining the fluid in contact with the at least one annuli to at least partially immobilize the fluid wherein the plastic hollow microspheres are expanded particulates of an organic resin and a heat expandable liquid or gas and further wherein the amount of plastic hollow microspheres in the thermal insulating fluid is between from about 0.1 to about 5 weight percent.

13. A method for reducing convection flow velocity in at least one annuli surrounding a production tubing or transfer pipe, comprising:

(a) introducing into the at least one annuli an insulating packer or riser fluid comprising a thermal insulating composition comprising:
  (i) a viscosifying polymer and;
  (ii) plastic hollow microspheres; and
(b) maintaining the fluid in the at least one annuli until the convection flow velocity is reduced wherein the plastic hollow microspheres are expanded particulates of an organic resin and a heat expandable liquid or gas and further wherein the amount of plastic hollow microspheres in the thermal insulating composition is between from about 0.1 to about 5 weight percent.

14. The method of claim 1, wherein the boiling point of the heat expandable liquid or gas is lower than the softening temperature of the organic resin.

15. The method of claim 11, wherein the boiling point of the heat expandable liquid or gas is lower than the softening temperature of the organic resin.

16. The method of claim 13, wherein the boiling point of the heat expandable liquid or gas is lower than the softening temperature of the organic resin.

17. The method of claim 13, wherein the fluid is a packer fluid and is introduced above a packer in at the least one annuli.

18. The method of claim 13, wherein the fluid is a riser fluid and is introduced into a riser annulus.

19. The method of claim 1, wherein the liquid or gas is selected from the group consisting of propane, butane, pentane, isobutane, neopentane and mixtures thereof.

20. The method of claim 13, wherein the liquid or gas is selected from the group consisting of propane, butane, pentane, isobutane, neopentane and mixtures thereof.

21. The method of claim 1, wherein the organic resin is selected from the group consisting of epoxy resins, urea-formaldehyde resins, phenolic resins and thermoplastic materials.

* * * * *

UNITED STATES PATENT AND TRADEMARK OFFICE

CERTIFICATE OF CORRECTION

PATENT NO. : 7,625,845 B2
APPLICATION NO. : 11/595295
DATED : December 1, 2009
INVENTOR(S) : Wang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 454 days.

Signed and Sealed this

Second Day of November, 2010

David J. Kappos

David J. Kappos
*Director of the United States Patent and Trademark Office*